United States Patent [19]

Brown

[11] 4,056,051

[45] Nov. 1, 1977

[54] HARD BOILED EGG EXTRACTOR

[76] Inventor: Ernest A. Brown, 410 W. Clark St., Springfield, Ohio 45506

[21] Appl. No.: 717,613

[22] Filed: Aug. 25, 1976

[51] Int. Cl.[2] ..... A23B 4/08; A23B 4/12; A23N 5/00; A47J 17/00

[52] U.S. Cl. ..... 99/516; 99/568

[58] Field of Search ..... 92/516, 536, 568; 30/120.1

[56] References Cited

U.S. PATENT DOCUMENTS

| | | | |
|---|---|---|---|
| 1,618,682 | 2/1927 | Snapp | 99/568 |
| 2,424,425 | 7/1947 | Yates | 99/516 |
| 2,962,067 | 11/1960 | Mesojedec | 99/516 |
| 3,951,055 | 4/1976 | Woebbeking | 99/568 |

*Primary Examiner*—Harvey C. Hornsby
*Assistant Examiner*—Robert Pous
*Attorney, Agent, or Firm*—Victor J. Evans & Co.

[57] ABSTRACT

A handy, light weight tool that is used to automatically shell a hard boiled egg. The egg shell is punctured at both ends, and the complete egg is inserted about half of its length into the tool. When either water or air pressure is then applied to the tool the egg is squirted out of its shell and the open end of the tool.

2 Claims, 3 Drawing Figures

HARD BOILED EGG EXTRACTOR

BACKGROUND OF THE INVENTION

The present invention involves improvements in a tool used in the preparation of food in the home and in public places (i.e. hotels, restaurants, etc.). The tool is called a hard boiled egg extractor, as it removes the egg from its shell. Regardless of whether the the egg is hot or cold, this can be done mechanically, more efficiently, and sanitarily than the means presently used. It is especially valuable to the physically handicapped (i.e. sight impairment) and for rush orders in restaurants. The hard boiled egg extractor is a real time saver.

FIELD OF THE INVENTION

The present invention relates to a tool for extracting hard boil eggs.

SUMMARY OF THE INVENTION

The present invention of a tool for extracting hard boiled eggs includes a semi-spherical holder, which is light weight and made of either rubber or plastic, and is connected at its upper end to a source of either water or air pressure. A hard boiled egg, with a hole put in each end of its shell, is then inserted into the holder, so that the egg goes into the holder a little more than half of its length and thus blocks the passageway through the holder. Water or air pressure is applied causing the side walls of the holder to grasp the egg. The pressure then escapes by going through the top hole in the egg shell and squirting the egg itself out of the bottom hole in the shell.

The primary object of the invention is to provide a tool which serves as a hard boiled egg extractor.

Other objects and advantages will become apparent in the following specification when considered in light of the attached drawings.

DESCRIPTION OF THE PREFERRED EMBODIMENT

Figure 1:
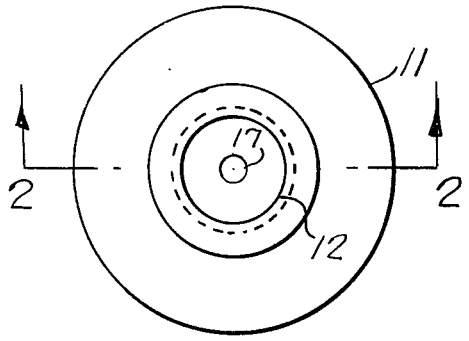
FIG. 1 is a top plan view of the tool making up the invention.
Figure 2:
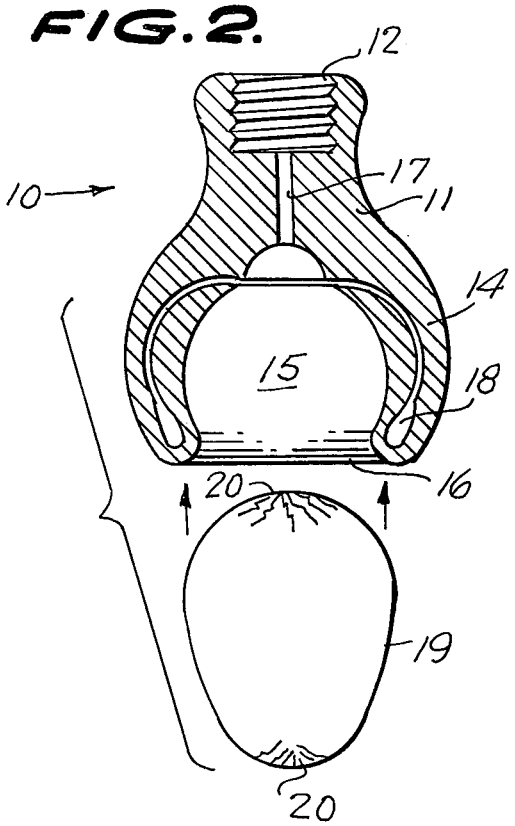
FIG. 2 is a view taken along line 2—2 of FIG. 1 looking in the direction of the arrows.
Figure 3:
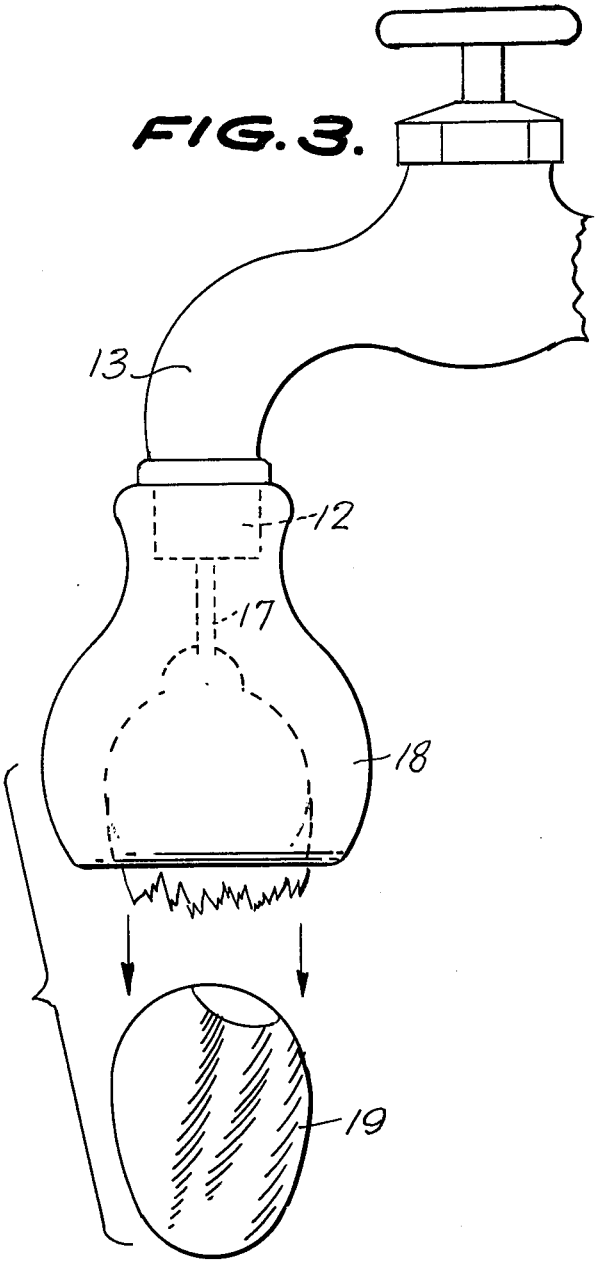
FIG. 3 is an elevation view of the invention connected to a source of water pressure.

Referring now to the drawings in detail, wherein like reference characters indicate like parts throughout the several figures, the reference numeral 10 indicates generally the tool making up the invention.

The tool 10 is made up of a substantially U-shaped holder 11 which is light in weight and constructed of material such as rubber or plastic that will be slightly deformable. The upper end of holder 11 has threads 12 making the holder 11 attachable to a source of power 13, in this case a water faucet.

The body of holder 11 is somewhat semi-spherical in shape, with curved side walls 14, a hollow center 15, and an open bottom 16. Down through the middle of holder 11, from threaded end 12 to the hollow center 15, there is a channel 17 for passage of the pressure.

The curved side walls 14 have a pressure tube 18 running down through their center, with the tube 18 being joined at its upper end by the hollow center 15, so that pressure will also feed into tube 18, to slightly deform the walls of the holder, as will be shown hereinafter.

A hard boiled egg 19 which is to be processed through the extractor has its sheel cracked at 20, at both ends, before it is inserted into the extractor.

In the use and operation of the invention the holder 11 has its threads 12 screwed onto a source of water pressure 13. Then a hard boiled egg 19 has holes 20 cracked into each end of the shell, and the egg is inserted up into the hollow center 15 of the holder 11. The hollow center 15 is just deep enough so that the lower edge 16 is slightly beyond the largest part of the egg diameter.

Pressure is now turned on, causing the side walls 14 to flex slightly and grasp the sides of the egg shell. As the pressure builds up, water will find its way through the upper hole 20 in the egg shell and thereby cause the meat of the egg to squirt out of the lower hole 20 in the shell.

Having thus described the preferred embodiment of the invention it should be understood that numerous structural modifications and adaptations may be resorted to without departing from the spirit of the invention.

What is claimed is:

1. A hard boiled egg extractor comprising a semi-sperical holder composed of an elastic material, curved sides and an open end on said holder to receive a hard boiled egg having holes in each end of its shell, means for attaching said holder to a source of pressure, means for conducting the pressure to the center of the holder including a pressure passage in the curved walls of the holder whereby said pressure flexes said walls and thereby holds the egg shell as the pressure expels the egg from the shell.

2. The device of claim 1 wherein the holder is made of light weight, flexible material.

* * * * *